United States Patent [19]

Basten et al.

[11] Patent Number: 4,483,524

[45] Date of Patent: Nov. 20, 1984

[54] UNITARY LATCHING AND RELEASE MEANS FOR PORTABLE FOLDABLE WORKBENCH

[75] Inventors: Frank Basten, Brockville; Peter Oxley, Mallorytown, both of Canada

[73] Assignee: Black & Decker Inc., Newark, Del.

[21] Appl. No.: 575,605

[22] Filed: Jan. 31, 1984

Related U.S. Application Data

[62] Division of Ser. No. 334,433, Dec. 24, 1981, Pat. No. 4,442,779.

[51] Int. Cl.[3] ..... A47B 3/00; B25B 1/22

[52] U.S. Cl. ..... 269/139; 269/219; 269/901; 108/131

[58] Field of Search ..... 108/125, 126, 121, 115, 108/131, 129; 269/139, 219–220, 901, 244; 144/285, 286 R

[56] References Cited

U.S. PATENT DOCUMENTS

| | | | |
|---|---|---|---|
| 1,727,833 | 9/1929 | Kress et al. | 108/125 |
| 2,558,915 | 7/1951 | Sheffer | 108/125 |
| 2,665,181 | 1/1954 | Pucci | 108/131 |
| 3,615,087 | 10/1971 | Hickman | 269/244 |
| 4,169,606 | 10/1979 | Hickman | 269/139 |
| 4,378,107 | 3/1983 | Wagster et al. | 269/139 |

FOREIGN PATENT DOCUMENTS

| | | | |
|---|---|---|---|
| 819420 | 10/1937 | France | 108/125 |
| 465437 | 5/1937 | United Kingdom | 108/125 |

*Primary Examiner*—Robert C. Watson

*Attorney, Agent, or Firm*—Ronald B. Sherer; Harold Weinstein; Edward D. Murphy

[57] ABSTRACT

A pair of manually-manipulatable spring-loaded buttons are accessible outwardly of the side walls of a pair of respective vise brackets secured beneath the table of a portable foldable workbench. When the buttons are pressed laterally inwardly, respective latching mechanisms are released to enable the workbench to be raised from a lowered storage position into an erected working position, and vice-versa. The buttons facilitate a rapid movement of the workbench from one position to another, and the buttons are conveniently located on the workbench for improved ergonomics.

15 Claims, 9 Drawing Figures

UNITARY LATCHING AND RELEASE MEANS FOR PORTABLE FOLDABLE WORKBENCH

This is a division of application Ser. No. 334,433, filed Dec. 24, 1981, now U.S. Pat. No. 4,442,779.

BACKGROUND OF THE INVENTION

Portable foldable workbenches have been manufactured and sold, such as those described and claimed in U.S. Pat. No. 3,615,087 issued on Oct. 26, 1971. These workbenches have a table, a base, and a supporting structure therebetween. The supporting structure is pivotably connected to the base and table, respectively, thereby enabling the workbench to be moved from a raised erected position into a lowered storage position, and vice-versa. First and second resiliently-biased latching means, separate and distinct from one another, are provided to maintain the workbench in its raised and lowered positions, respectively; and each of these latching means may be selectively released to enable the workbench to be moved from one position into another position. This selective unlatching is facilitated by manually-manipulatable release means, which like the latching means, are complete separate and distinct from each other. While completely functional and satisfactory for the purposes intended, nevertheless, the latching means and the manually-manipulatable release means could be improved.

SUMMARY OF THE INVENTION

Accordingly, it is an object of the present invention to provide an improved latching and release means for a portable foldable workbench of the type described.

It is another object of the present invention to provide, in a workbench of the type described, a single unitary release means which is selectively operable to disengage either the first or second latching means, respectively.

It is yet another object of the present invention to provide, in a workbench of the type described, a single manually-manipulatable actuator button for improved ergonomics.

It is a further object of the present invention to provide a release means which cooperates with the pivoting supporting structure to reduce any looseness in the portable foldable workbench.

It is a still further object of the present invention to reduce the number of components and their assembly time, thus further facilitating the economical fabrication and manufacture of the workbench on a volume mass-production basis.

In accordance with the teachings of the present invention, the portable foldable workbench includes a base, a table having a pair of spaced brackets secured thereto, each bracket having a slotted opening formed therein, and an intermediate supporting structure pivotably connected between the brackets and the base and including a pair of transverse supporting struts, one for each of the brackets. A unitary latching and release mechanism is provided between the table and the supporting structure, and between the supporting structure and the base, respectively. This mechanism includes a first latching means which is automatically operative between the pivoted supporting strut and the bracket as the workbench is raised into its erected position, and a first resilient means maintains the first latching means in its engaged position in the erected position of the workbench. A second latching means is automatically operative between the bracket and the base, as the workbench is lowered into its storage position, and a second resilient means maintains the second latching means in its engaged position in the lowered position of the workbench. Means are provided, including a single manually-manipulatable button adapted to be pressed laterally inwardly of the bracket, for selectively releasing either the first or second latching means against the bias force of the first and second resilient means, respectively, thereby enabling the workbench to be moved from one position to another.

These and other objects of the present invention will become apparent from a reading of the following description, taken in conjunction with the enclosed drawings.

DESCRIPTION OF THE PREFERRED EMBODIMENT

Figure 2:
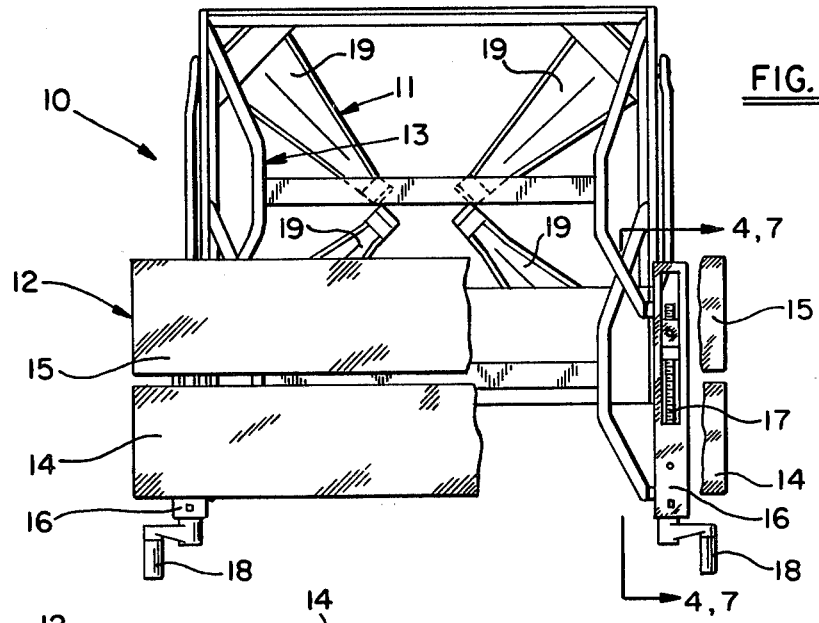
FIG. 2 is a top plan view thereof, with part of the table being broken away to shown one of the vise brackets.
Figure 1:
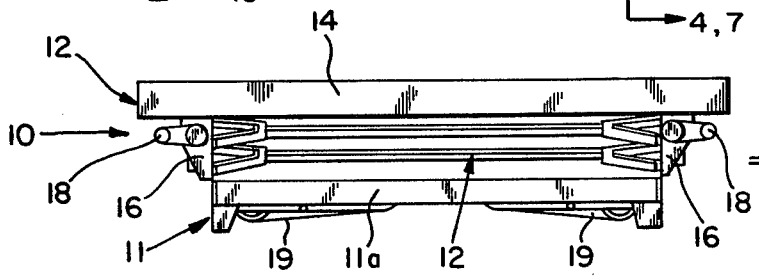
FIG. 1 is a front elevation of the workbench folded into its lowered, storage position.
Figure 3:
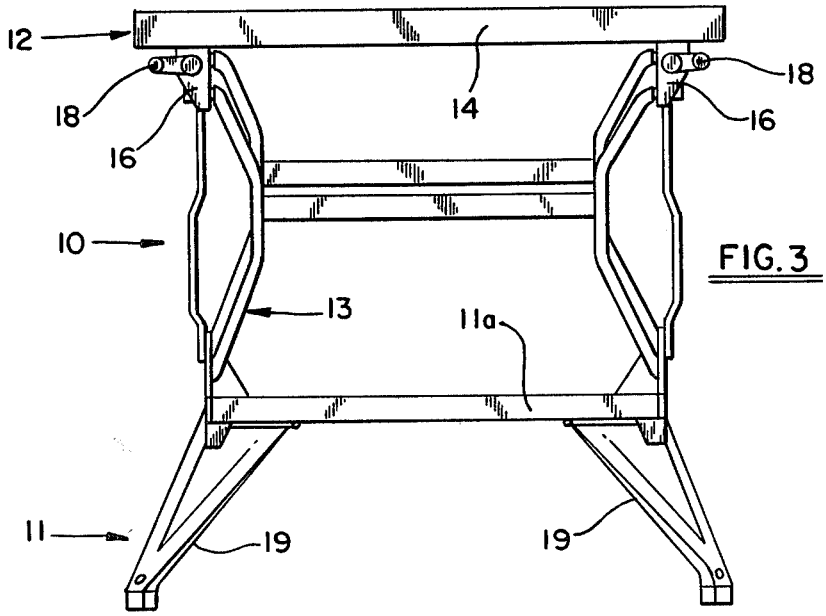
FIG. 3 is a front elevation of the workbench in its raised, erected position.

With reference to FIGS. 1–3, there is illustrated a portable foldable workbench 10 with which the teachings of the present invention may find more particular utility. It will be appreciated, however, that the broad teachings of the present invention are not confined to the specific workbench 10, but rather are equally applicable to a wide variety of portable or foldable benches and worktables suitable for use by carpenters, mechanics, and home craftsmen. With this in mind, the workbench generally comprises a base 11 including a step **11*a*, a table 12, and an intermediate supporting structure 13. The supporting structure facilitates a collapsing or folding of the workbench from its erected position (as shown in FIG. 3) into its lowered compact position (as shown in FIGS. 1 and 2**) for convenient storage and portabiity. In the lowered position of the workbench, its table lies substantially parallel to the base and in spaced juxtaposition thereto. Additionally, the supporting structure facilitates the raising of the workbench from its lowered storage position into its erected position (as hereinafter described).

Preferably, but not necessarily, the table of the workbench is formed integrally as a giant vise, including a fixed front vise jaw 14 and a movable rear vise jaw 15. These vise jaws are elongated, as shown in FIG. 2, and are disposed transversely of a pair of spaced parallel vise brackets, one of which is shown as at 16 in FIG. 2. The front vise jaw is fixed to the brackets, and the rear vise jaw is supported on the brackets for movement towards the front vise jaw for clamping a workpiece therebetween. The means for moving the rear vise jaw includes a pair of independently-operable screw-threaded rods 17 actuated by respective crank handles 18, as shown in FIG. 2.

The vise mechanism and table structure, as well as the pivotable intermediate supporting structure between the base and the table, form no part of the present invention and are disclosed in the aforesaid U.S. Pat. No. 3,615,087. Moreover, the base includes four pivotable legs 19, which provide a dual-height feature; this feature allows the workbench to be used either as a saw horse or as a bench. Again, the leg structure forms no part of the present invention, being disclosed in U.S. Pat. No. 4,034,684 issued on July 12, 1977.

Figure 7:
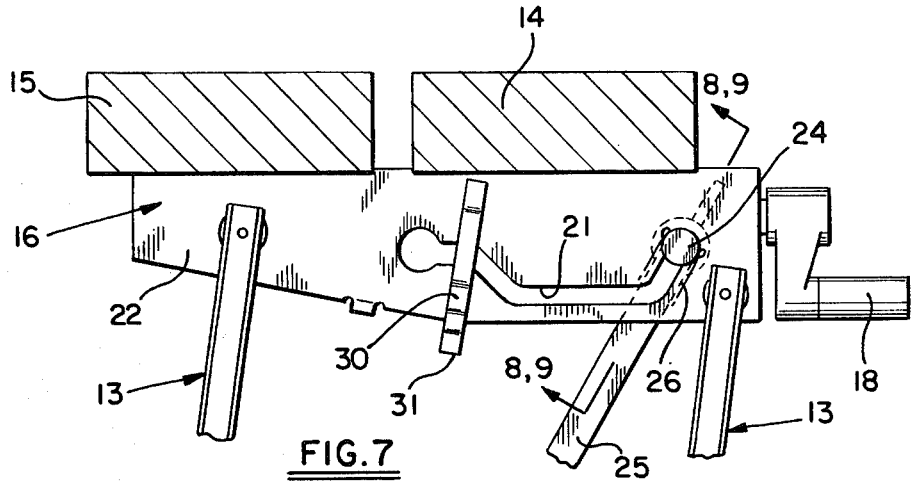
FIG. 7 corresponds to FIG. 4, but shows the mechanism in its alternate position in the erected position of the workbench.
Figure 8:
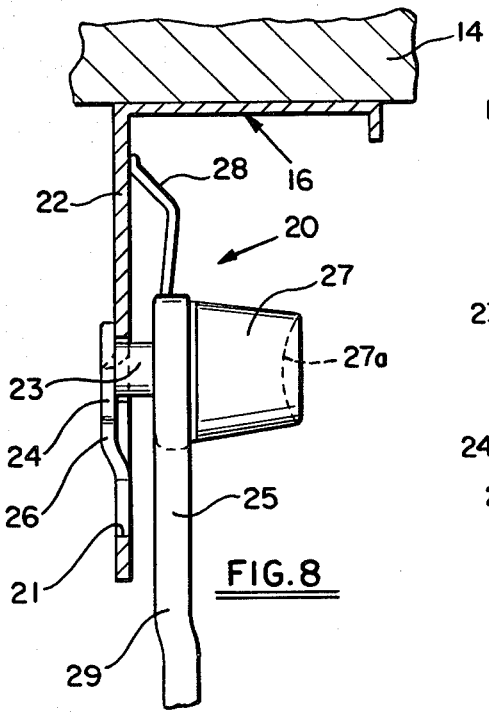
FIG. 8 is a section view, taken along the lines 8—8 of FIG. 7, and showing a first latching means operative between the bracket and the pivoted supporting strut to retain the workbench in its erected position.

With reference to the remaining drawings, a pair of unitary latching and release mechanisms 20 are provided in accordance with the teachings of the present invention. The mechanisms are located on respective sides of the workbench, and since the mechanisms are identical, only one mechanism will be described herein. A slotted opening 21 is formed in a side wall 22 of each vise bracket, and a stud 23 having a shouldered portion 24 is slidably received in the slotted opening. The stud is connected to a transverse supporting strut 25 (which is part of the intermediate supporting structure of the workbench). Near one end of the slotted opening, and on either side thereof, a raised emboss 26 is formed in the side wall of the bracket. The stud is normally received in the end of the slotted opening and adjacent to the raised emboss, as shown in FIGS. 7 and 8, in the erected position of the workbench.

Figure 9:
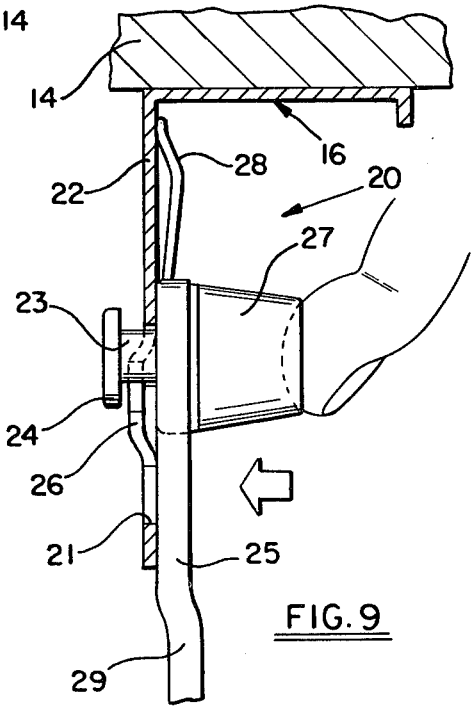
FIG. 9 corresponds to FIG. 8, but shows the first latching means released to disengage the bracket and the strut.

A manually-manipulatable button 27 (formed with a concave recess 27*a*) is secured to the stud on the other side of the wall. The button has an integral spring finger 28 bearing against the side wall of the bracket, thereby providing a resilient bias force on the stud. The button is accessible outwardly of the bracket (and hence outwardly of the workbench) and may be pressed laterally inwardly of the bracket (in the direction of the arrow in FIG. 9) so as to lift the stud away from the side wall of the bracket, thereby enabling the stud to clear the raised emboss, and thereby enabling the stud to thereafter slide in one direction along the slotted opening in the bracket. As the stud slides within the slotted opening, the pivoted supporting strut is carried conjointly therewith, thereby facilitating the collapsing or folding of the workbench from its erected position into its lowered position. Moreover, the supporting strut is deliberately bent, as at 29, thereby providing an additional resilient bias on the stud.

Figure 4:
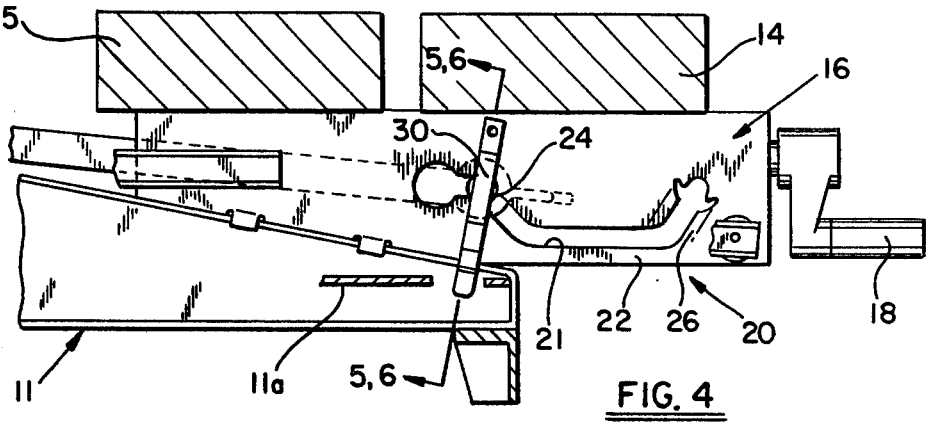
FIG. 4 is a view, taken along the lines 4—4 of FIG. 2 and drawn to an enlarged scale, showing the components of the unitary latching and release mechanisms of the present invention.
Figure 5:
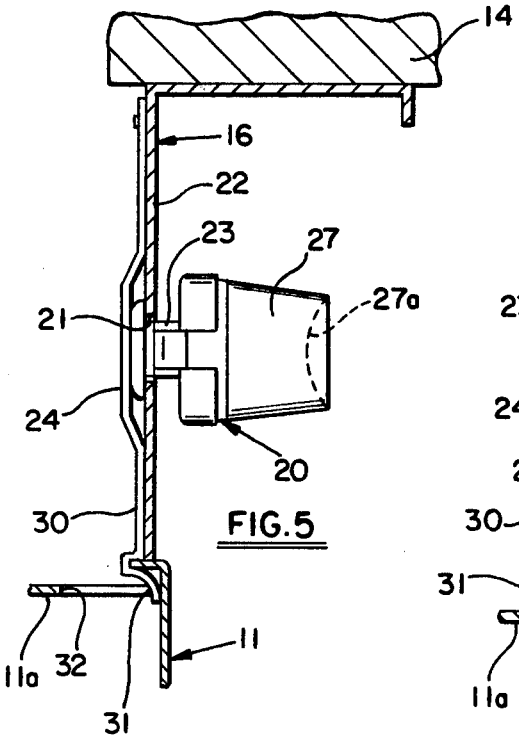
FIG. 5 is a section view, taken along the lines 5—5 of FIG. 4, and showing a second latching means operative between the bracket and the base to retain the workbench in its lowered position.
Figure 6:
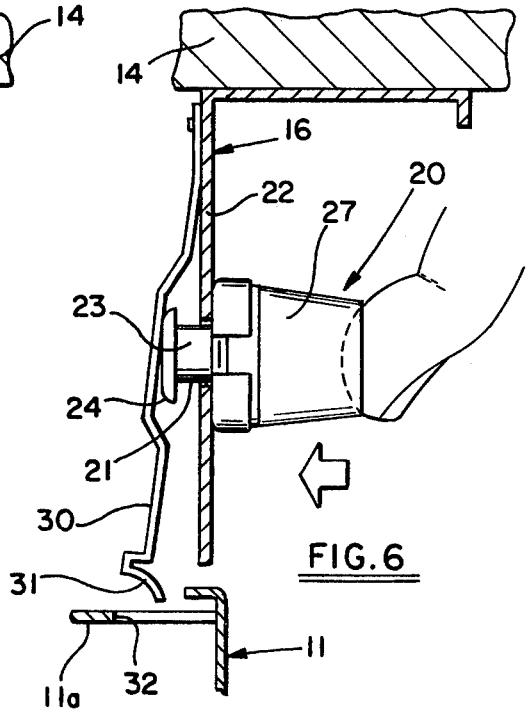
FIG. 6 corresponds to FIG. 5, but shows the second latching means released to disengage the bracket from the base.

The alternate position of the stud in the slotted opening, corresponding to the lowered position of the workbench, is shown in FIGS. 4 and 5. In this position, the stud is received near the other end of the slotted opening in the bracket. A spring latch 30 has one end thereof welded (or otherwise secured) to the side wall of the bracket, overlying the stud, and has a bent opposite end portion 31 extending beyond the bracket and received within an opening 32 formed in the step portion of the base. With this arrangement, the supporting structure of the workbench is automatically latched to the base, as the workbench is lowered into its storage position. When it is desired to raise the workbench, the button is again pressed laterally inwardly (in the direction of the arrow in FIG. 6), thereby pressing against the spring latch, and thereby releasing the end of the latch from the opening in the base. Thereafter, the stud may be moved in the opposite direction in the slotted opening in the bracket, and the stud will ride over the raised emboss and will be received in the one end of the slotted opening with a "snap action", thereby maintaining the workbench in its erected position.

Thus, a first latching means is provided between the table and the supporting structure, which is automatically operative as the workbench is raised into its erected position, and a first resilient means is provided for maintaining the first latching means. Moreover, a second latching means is provided between the supporting structure and the base, which is automatically operative as the workbench is lowered into its storage position, and a second resilient means is provided for maintaining the second latching means. More significantly, however, the means for selectively releasing the first and second latching means, against the bias force of the first and second resilient means, respectively, comprises a single unitary manually-manipulatable member—the button 27—thereby facilitating the rapid and convenient movement of the workbench from one position into another. Additionally, the operator knows instinctively which member (the button) to press to release the respective latches—the member is the same for raising or lowering the workbench—and thus the ergonomics are substantially improved.

Obviously, many modifications may be made without departing from the basic spirit of the present invention. Accordingly, it will be appreciated by those skilled in the art that within the scope of the appended claims, the invention may be practiced other than has been specifically described herein.

We claim:

1. In a portable workbench having an erected position and a storage position, the combination of a base, a table formed integrally with a vise and including a pair of vise jaws movable relative to each other for clamping a workpiece therebetween, a supporting structure between the base and the table, the supporting structure including a pair of spaced vise brackets, means including a pair of independently-operable screw-threaded rods carried by the brackets, respectively, for moving the vise jaws relative to one another, means for collapsing the supporting structure to enable the workbench to be moved from its erected position into its storage position, first latching means to retain the workbench in its erected position, second latching means to retain the workbench in its storage position, and a single unitary means selectively operable in either the erected or storage position of the workbench to release the first and second latching means, respectively, to thereafter enable the workbench to be moved from one position into another position, said last-named means including a single manually-manipulatable member extending laterally outwardly of each bracket.

2. The combination claimed in claim 1, wherein:

the supporting structure further including two transverse pivoted supporting struts, each one connected to a respective vise bracket.

3. The combination claimed in claim 2, wherein:

the first latching means being automatically operative between a pivoted supporting strut and a respective vise bracket as the workbench is raised into its erected position.

4. The combination claimed in claim 3, further comprising:

first resilient means, having a bias force, for maintaining the first latching means in an engaged position in the erected position of the workbench.

5. The combination claimed in claim 4, wherein:

the single manually-manipulatable member including a button adapted to be pressed laterally inwardly of the vise bracket and against the bias force of the first resilient means to release the first latching means, thereby enabling the supporting strut to be pivoted relative to the vise bracket.

6. The combination claimed in claim 2, wherein:

the second latching means being automatically operative between a vise bracket and the base as the workbench is folded into its lowered position.

7. The combination claimed in claim 6, further comprising:

second resilient means, having a bias force, for maintaining the second latching means in an engaged position in the lowered position of the workbench.

8. The combination claimed in claim 7, wherein:

the single manually-manipulatable member being movable laterally inwardly against the bias force of the second resilient means to release the second latching means, thereby disconnecting the bracket from the base and enabling the workbench to be raised.

9. The combination claimed in claim 2, further comprising:

first resilient means for maintaining the first latching means in an engaged position in the erected position of the workbench; and second resilient means for maintaining the second latching means in an engaged position in the lowered position of the workbench.

10. The combination claimed in claim 9, wherein:

each vise bracket having a side wall defining a slotted opening having an end;

said first latching means including a raised emboss formed on one side of each vise bracket side wall near said slotted opening end, and a shouldered stud connected to one end of each supporting strut and being slideably movable in said slotted opening, whereby the supporting strut is carried conjointly with the stud, said stud further being normally located at said one end of the slotted opening adjacent to said raised emboss in the erected position of the workbench; and each manually-manipulatable member including a button secured to the stud on the other side of the vise bracket side wall.

11. The combination claimed in claim 10, wherein:

said first resilient means including a spring finger connected to the button and bearing against the side wall of the vise bracket, the stud being cleared from the raised emboss responsive to depression of the button laterally inwardly against the bias of the spring fingers, whereby the stud is enabled to slide in one direction within the slotted opening.

12. The combination claimed in claim 11, wherein:

the stud being received at the other end of the slotted opening in the lowered position of the workbench.

13. The combination claimed in claim 12, wherein:

the second resilient means including a spring latch connected to each vise bracket transversely of the slotted opening and overlying the stud in the lowered position of the workbench; and the second latching means including an opening formed in the base, and an end portion formed on the spring latch engageable with said base opening to retain the workbench in its lowered position.

14. The combination claimed in claim 13, wherein:

the latch end portion being cleared from the base responsive to laterally inward depression of the button to push the stud against the bias of the latch, thereby enabling the workbench to be raised.

15. The combination claimed in claim 14, wherein:

the workbench being retained in its erected position responsive to sliding movement of the stud in the opposite direction within the slotted opening until said stud slides over the raised emboss with a snap-action.

* * * * *